US006035552A

United States Patent [19]

Krüger et al.

[11] Patent Number: 6,035,552

[45] Date of Patent: Mar. 14, 2000

[54] HOUSEHOLD DRYER WITH A PROCESS AIR LOOP FOR REMOVING MOISTURE FROM LAUNDRY

[75] Inventors: Manfred Krüger; Manfred Schulz, both of Berlin, Germany

[73] Assignee: BSH Bosch und Siemens Hausgeraete GmbH, Munich, Germany

[21] Appl. No.: 09/164,480

[22] Filed: Oct. 1, 1998

[30] Foreign Application Priority Data

Oct. 1, 1997 [DE] Germany ..... 197 43 509

[51] Int. Cl.[7] ..... F26B 11/02

[52] U.S. Cl. ..... 34/595; 34/604; 165/111

[58] Field of Search ..... 34/468, 469, 73, 34/76, 79, 86, 595, 596, 604; 165/164, 111

[56] References Cited

U.S. PATENT DOCUMENTS 5,136,792 8/1992 Janecke ..... 34/78
5,220,955 6/1993 Stokes ..... 165/54

FOREIGN PATENT DOCUMENTS 30 27 900 A1 2/1982 Germany .

*Primary Examiner*—Pamela A. Wilson
*Attorney, Agent, or Firm*—Herbert L. Lerner; Laurence A. Greenberg; Werner H. Stemer

[57] ABSTRACT

A blower moves cooling air through the primary side of an air-to-air heat exchanger and process air the secondary side. The efficiency of the heat exchanger is increased in that the primary side is divided into at least two portions, through which the cooling air flows in series.

10 Claims, 2 Drawing Sheets

HOUSEHOLD DRYER WITH A PROCESS AIR LOOP FOR REMOVING MOISTURE FROM LAUNDRY

BACKGROUND OF THE INVENTION

1. Field of the Invention

The invention relates to a household laundry dryer with a process air loop that removes moisture from laundry. A secondary side of an air to air heat exchanger is connected into the process air loop, the primary side of the heat exchanger is acted upon by cooling air, and the process air moved by means of a blower.

2. Description of the Related Art

A household dryer of the foregoing type has become known, heretofore, from German published patent application DE 30 27 900 A1. There, a household dryer is provided with a heat exchanger for cooling the process air that flows through the laundry drum of the dryer. The heat exchanger is made up of a plurality of plates, stacked one above the other in spaced relationship in a tunnel-like housing, which form condenser surfaces for the process air. The process air fed by a blower flows through the spaces between the plates. The plates themselves comprise two spaced-apart parallel sheets, between which ribs are inserted, thereby forming many flow channels. Cooling air is blown through the flow channels by means of a blower. The process air flowing through the spaces between the plates is thus cooled down, causing the moisture previously absorbed in the flow through the dryer to condense. In the prior dryer, the cooling air must distribute itself over a short distance from the relatively small outlet opening of the blower across the large inlet cross section of the heat exchanger. This leads to uneven impingement on the heat exchanger, so that in the final analysis the full cooling capacity is not achieved.

SUMMARY OF THE INVENTION

It is accordingly an object of the invention to provide a household laundry dryer with a process air loop for removing moisture from the laundry, which overcomes the above-mentioned disadvantages of the heretofore-known devices and methods of this general type and which provides for more uniform impingement on the condenser surfaces and thus better cooling capacity of the heat exchanger.

With the foregoing and other objects in view there is provided, in accordance with the invention, a claim 1.

In a household dryer of the type having a process air loop for removing moisture from laundry, a blower moving process air through the process air loop, and an air to air heat exchanger having a secondary side connected in the process air loop and a primary side acted upon by cooling air, the improvement which comprises:

the primary side of the air to air heat exchanger being subdivided into a plurality of portions, through which the cooling air flows in series.

In other words, the objects of the invention are satisfied by the dividing of the primary side into at least two portions, through which the cooling air flows in series. By means of such subdivision in series connection of the primary side, a smaller inlet area at the heat exchanger is obtained for the cooling air, and thus a more-favorable ratio to the outlet cross section of the blower that feeds the cooling air. Thus even if there is a short distance between the blower and the heat exchanger, more-uniform distribution of the inflowing cooling air is attained.

In accordance with an added feature of the invention, the process air loop has an inlet region at which the process air enters the heat exchanger and an outlet region at which the process air leaves the heat exchanger. The first portion through which the cooling air flows first is disposed in the outlet region and the second portion through which the cooling air flows last is disposed in the inlet region. This feature utilizes the countercurrent principal of the two cooling air portions, which is favorable for intensive cooling. The process air, already cooled somewhat toward the outlet region of the secondary side, is acted upon by the as yet unheated cooling air, and in the inlet region of the secondary side, the still-hot process air is acted upon by the cooling air that has been heated somewhat in the preceding portion. Thus over the entire flow course of the process air through the heat exchanger, a high temperature difference between the cooling air and the process air exists.

In accordance with an advantageous feature of the invention, the first and second portions have mutually identical flow cross sections.

In accordance with an additional feature of the invention, the cooling air and the process air flow transversely relative to one another. This is particularly favorable with regard to the structural design of the heat exchanger.

In accordance with another feature of the invention, a deflection channel is connected between a cooling air outlet opening of the first portion of the plurality of portions and a cooling air inlet opening of the second portion of the plurality of portions. For the series connection of the individual portions of the primary side, the engineering expense can thereby be kept low. The cooling air emerging from the first portion is deflected directly into the other portion.

In accordance with again another feature of the invention, the cooling air emerging from the heat exchanger is aimed at the drive mechanism of the blower. Typically, such blowers are driven by electric motors and a higher degree of utilization of the electric motors that drive the blowers is thus attained. A substantial economy in terms of space is obtained in that the blower that feeds the cooling air and the blower that feeds the process air are driven by a common motor.

With the above and other objects in view there is also provided, in accordance with the invention, a household dryer with the following features:

a laundry drum (drying space) for receiving laundry to be dried;

a process air loop communicating with the laundry drum and a blower moving process air through the process air loop for removing moisture from the laundry in the laundry drum;

an air to air heat exchanger having a secondary side connected in the process air loop and a primary side acted upon by cooling air, the primary side of the air to air heat exchanger being subdivided into a plurality of (two or more) portions through which the cooling air flows in series.

Other features which are considered as characteristic for the invention are set forth in the appended claims.

Although the invention is illustrated and described herein as embodied in a household dryer with a process air loop that removes moisture from laundry, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
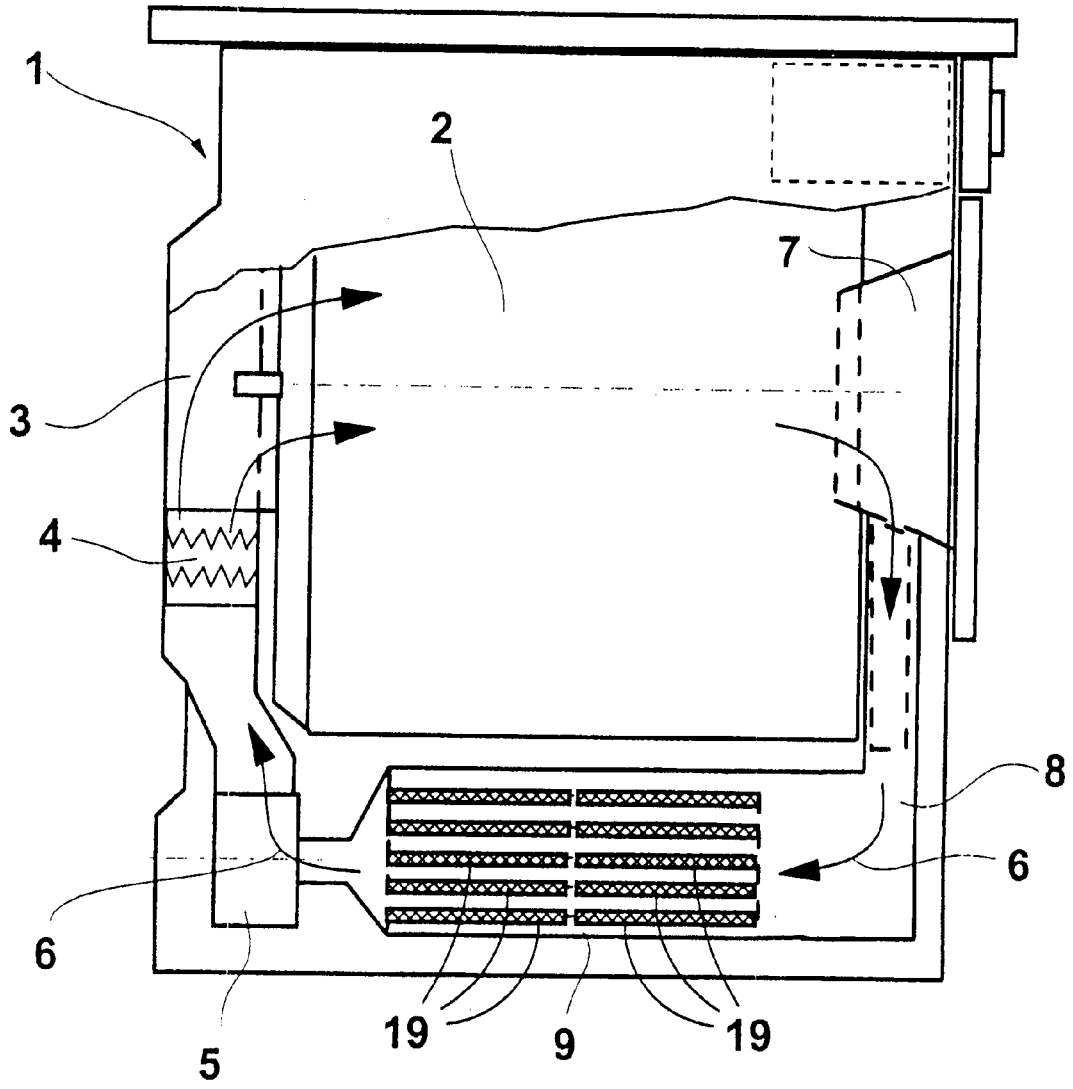
FIG. 1 is a partly broken-away, partly diagrammatic side elevation of a dryer with a built-in heat exchanger.

Referring now to the figures of the drawing in detail and first, particularly, to FIG. 1 thereof, there is seen a dryer formed with a drying space (laundry drum 2) provided in its housing 1. Via an air inlet conduit 3, in which a heat body 4 is disposed, process air (arrows 6) is blown into the drying space 2 by means of a first blower 5. The process air 6 is carried in a closed loop and in the region of the loading opening 7 of the dryer flows back via a return air conduit 8 to a heat exchanger 9 built into the housing 1 of the dryer. On flowing through the heat exchanger 9, the process air 6 is cooled down against the plates 19. The moisture absorbed by the process air in the drying space 2 is thus condensed and then carried away to the outside out of the heat exchanger 9.

Figure 2:
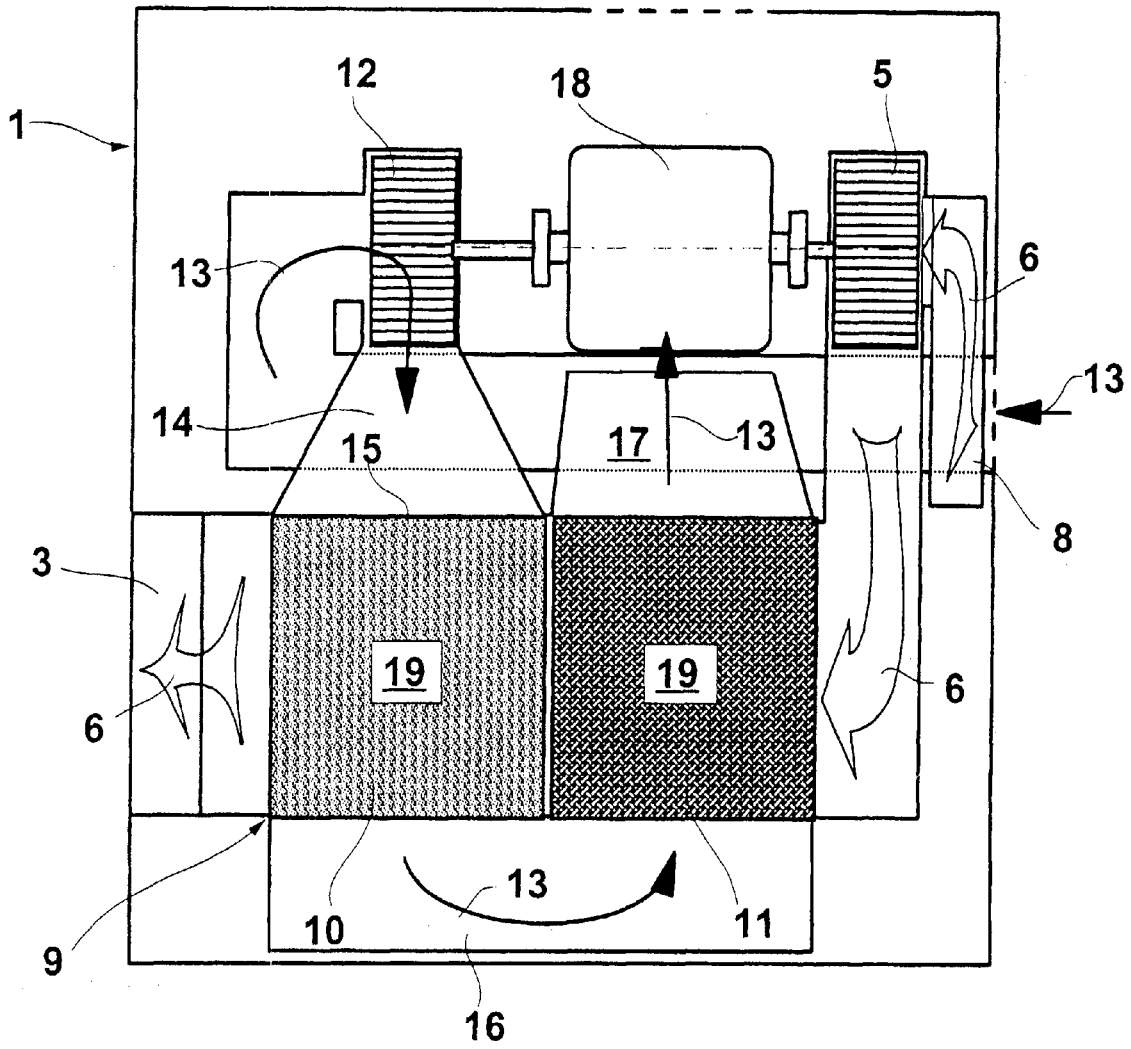
FIG. 2 is a top view onto a heat exchanger according to the invention, with a primary side subdivided into a plurality of portions.

The configuration of the heat exchanger 9 will now be described with reference to FIG. 2. In the known manner, a heat exchanger has a primary side and a secondary side. In the heat exchanger 9 shown in FIG. 2, the generally flat plate packets 19, arranged in a grid pattern, form the primary side and are subdivided into a first and a second portion 10 and 11, respectively. Cooling air (arrows 13 drawn in solid lines) flows through them, fed by a second blower 12. The cooling air 13 is carried through an infeed channel 14 from the outlet opening of the second blower 12 to the inlet side 15 of the first portion 10. On the side, opposite the inlet side 15, of the primary side of the heat exchanger, a deflection channel 16 is provided, through which the cooling air 13, which has emerged from the first portion 10 of the primary side, is deflected toward the second portion 11 and flows through it as well. After flowing through the second portion 11, the cooling air 13 is deflected via an outflow channel 17 to a motor 18 that jointly drives the two blowers 5 and 12. The motor 18 is thereby cooled. As a consequence of this intensive cooling, higher utilization of the motor 18 is possible, and so under some circumstances a motor of lower rated capacity can be used. The blown-out cooling air is also distributed within the interior of the housing and can escape through the housing screen located next to the motor.

The process air 6 (drawing in hollow arrows in FIG. 2) is passed through the secondary side of the heat exchanger 9. The primary side and the secondary side are placed in the heat exchanger 9 in such a way that the flow directions of the cooling air 13 and the process air 6 are oriented transversely to one another.

The first portion 10 of the primary side, communicating with the second blower 12 via the infeed channel 14, is disposed on the outlet side of the process air channel, and the second portion 11 of the primary side is disposed on the inlet side of the process air channel. As a result, it is attained that the freshly inflowing cooling air 13 is subjected to a heat exchange only with the already partly cooled-down process air 6 in the outlet region of the process air channel. In the inlet region of the process air channel, the cooling air 13, already somewhat heated in the first portion 10, is then subjected to a heat exchange with the as yet uncooled process air 6. Thus there is a uniform and high temperature difference in the two portions 10 and 11 between the cooling air 13 and the process air 6, so that the favorable cooling action of a countercurrent principle is achieved.

By subdividing the primary side into at least two portions 10 and 11 connecting them in series, a higher flow speed is attained, for the same cooling air quantity, than in an undivided primary side, because of the smaller flow cross section of the portions 10 and 11. In addition, because of the more-favorable ratio of the outlet cross section of the second blower 12 to the inlet cross section of the first portion 10, the flow is more uniform. Both favors contribute to increasing the efficiency of the heat exchanger 9.

The entire block of the heat exchanger 9, including the two blowers 5 and 12 driven by the common motor 18, is also distinguished by a space-saving design.

We claim:

1. In a household dryer of the type having a process air loop for removing moisture from laundry, a blower moving process air through the process air loop, and an air to air heat exchanger having a secondary side connected in the process air loop and a primary side acted upon by cooling air, the improvement which comprises:

the primary side of said air to air heat exchanger being subdivided into a plurality of portions, through which the cooling air flows in series, said air to air heat exchanger being configured such that the cooling air and the process air flow transversely relative to one another in said air to air heat exchanger.

2. The dryer according to claim 1, wherein the process air loop is defined with an inlet region at which the process air enters the heat exchanger and an outlet region at which the process air leaves the heat exchanger, and wherein said plurality of portions includes a first portion through which the cooling air flows first disposed in said outlet region and a second portion through which the cooling air flows last disposed in said inlet region.

3. The dryer according to claim 2, wherein said first and second portions have mutually identical flow cross sections.

4. The dryer according to claim 1, which further comprises a deflection channel connected between a cooling air outlet opening of a first portion of said plurality of portions and a cooling air inlet opening of a second portion of said plurality of portions.

5. The dryer according to claim 1, which further comprises a drive mechanism driving said blower, and wherein the cooling air emerging from said heat exchanger is aimed at said drive mechanism of said blower.

6. The dryer according to claim 1, which further comprises a common motor driving the blower moving the process air through the process air loop and a blower moving the cooling air through said heat exchanger.

7. The dryer according to claim 6, wherein the cooling air emerging from said heat exchanger is aimed at said common motor.

8. A household dryer, comprising:

a laundry drum for receiving laundry to be dried;

a process air loop communicating with said laundry drum and a blower moving process air through the process air loop for removing moisture from the laundry in said laundry drum;

an air to air heat exchanger having a secondary side connected in said process air loop and a primary side acted upon by cooling air, said primary side of said air to air heat exchanger being subdivided into a plurality of portions through which the cooling air flows in series, said air to air heat exchanger being configured such that the cooling air and the process air flow transversely relative to one another in said air to air heat exchanger.

9. The dryer according to claim 8, wherein said plurality of portions are two portions.

10. In a household dryer of the type having a process air loop for removing moisture from laundry, a blower moving process air through the process air loop, and an air to air heat exchanger having a secondary side connected in the process air loop and a primary side acted upon by cooling air, the improvement which comprises:

the primary side of said air to air heat exchanger being subdivided into a plurality of portions, through which the cooling air flows in series; and a common motor driving said blower moving the process air through the process air loop and a blower moving the cooling air through said heat exchanger, the cooling air emerging from said heat exchanger aimed at said common motor.

* * * * *